US005700211A

United States Patent [19]

Mackie

[11] Patent Number: 5,700,211

[45] Date of Patent: Dec. 23, 1997

[54] BALL FOR THROWING IN PATTERNS IN WHICH A BASEBALL CAN BE THROWN

[76] Inventor: Christopher Jon Mackie, 7174 Spring Hill Rd., Lewisville, N.C. 27023

[21] Appl. No.: 639,126

[22] Filed: Apr. 26, 1996

[51] Int. Cl.[6] ..... A63B 39/08

[52] U.S. Cl. ..... 473/613

[58] Field of Search ..... 273/60 R, 60 A, 273/60 B, 58 A, 58 B, 58 BA, 58 D, 58 K, 58 F; 473/569, 595, 596, 598, 600, 609, 612, 613

[56] References Cited

U.S. PATENT DOCUMENTS

| | | | |
|---|---|---|---|
| 465,507 | 12/1891 | Windoes | 273/60 R |
| 2,597,704 | 8/1952 | Carlson . | |
| 2,645,487 | 7/1953 | Hawes | 273/60 R |
| 2,665,739 | 1/1954 | Carlson et al. . | |
| 2,776,139 | 1/1957 | Blamey, Jr. et al. | 273/60 B |
| 4,874,169 | 10/1989 | Litchfield | 273/60 R |
| 4,930,776 | 6/1990 | Newcomb et al. | 273/58 B |
| 5,033,743 | 7/1991 | Wright | 273/60 B |
| 5,158,284 | 10/1992 | Vogl | 273/60 B |
| 5,280,906 | 1/1994 | Vitale | 273/60 R |

*Primary Examiner*—Steven B. Wong
*Attorney, Agent, or Firm*—Richard E. Jenkins, P.A.

[57] ABSTRACT

A ball is provided for throwing or hitting under circumstances unpractical or undesirable for a baseball and for throwing or hitting in patterns in which a baseball can be thrown or hit. The ball comprises a hollow, round sphere defining substantially equally spaced apart, circular holes therethrough. The outer surface of this sphere defines a series of separated ridges thereon which are structured, raised from and form a curved loop on the outer surface substantially similar to stitches on an actual baseball. In the preferred embodiment, the ball is constructed of high density polyethylene.

15 Claims, 3 Drawing Sheets

BALL FOR THROWING IN PATTERNS IN WHICH A BASEBALL CAN BE THROWN

TECHNICAL FIELD

The present invention relates generally to balls resembling baseballs, and more particularly, to a novel ball which can be used under circumstances unpractical or undesirable for a baseball and which can be thrown or hit in patterns in which a baseball can be thrown or hit.

PRIOR ART

As commonly known, the outer covering of a baseball consists of two (2) identically shaped sections which are stitched together at the seams thereof. These seams are typically raised slightly above the outer surface of the covering and often strategically placed or positioned in the hand of a pitcher throwing a baseball who can feel the stitches above the outer surface. By properly gripping and throwing a baseball, the raised stitches allow a baseball to be thrown in various patterns such as, for example, the curved path of a curve ball. Standard baseball pitches include a fast ball, a curve ball, a slider, and a knuckle ball, and all require the presence of the raised stitches on a baseball for the ability of the baseball to controllably follow such patterns.

Because of the weight and hardness of a baseball as well as the distance a baseball can travel, circumstances are often unpractical or undesirable for use of a real baseball. As such, there has been a need for a ball which is similar to a baseball but not as hard or heavy and which is somewhat limited in the speed and distance it can travel. This is especially true with regard to children and in circumstances in which a given play area is not suitable or practical for use of a real baseball because of geographic size limitations or other factors. Use of a real baseball can also be undesirable where a person, such as a pitcher, has suffered an injury such that he or she cannot or has a limited ability to throw or hit a real baseball.

A variety of baseball-like balls exist and have been utilized in place of a baseball under various circumstances. One such well known type of ball is constructed of soft plastic, usually low density polyethylene, and is hollow with a relatively thin outer wall and a plurality of circular apertures therethrough. The outer surface of the ball is completely smooth throughout. Because of the surface smoothness, throwing an assortment of baseball-like breaking pitches (curves, knuckleballs, slides, etc.) is not possible.

U.S. Pat. No. 2,597,704 to Carlson discloses a practice golf ball which is a spheroid constructed of a thermoplastic material and has a multiplicity of radial apertures through the wall of the spheroid. The practice golf ball can be driven with various golf clubs with full force wherein "slicing", "hooking" and/or "topping" patterns can be accomplished and are accentuated despite the large amount of air resistance encountered due to the apertures of the ball. When struck, the practice golf ball compresses readily upon impact.

Another baseball-like ball is the "WIFFLE® ball" manufactured by Wiffle Ball, Inc. of Shelton, Conn. The WIFFLE® ball has a smooth outer surface, and the WIFFLE® ball defines slotted apertures which exist on only one half of the WIFFLE® ball. The other half has a smooth surface with no apertures. When thrown or hit, the WIFFLE® ball understandably curves at random. The precise path of the ball when thrown or hit is difficult, if not impossible, to control.

Another type of ball which is common is a hard plastic ball resembling a baseball which is completely round and can be the size of a baseball but which has no holes or apertures. This type of ball typically has integrally molded ridges on the outer surface thereof resembling the stitching on a real baseball. Use of this type of ball, however, is frequently undesirable since its size, weight, hardness and lack of holes defined therethrough, cause the ball to travel in a fluttering or knuckle path and curving at random. This is particularly true, for example, when used by young children or in play areas which are geographically limited in size.

In view of the prior art balls, there exists much room for improvement in the art for a novel ball which can be used under circumstances unpractical or undesirable for a baseball, but which can be thrown or hit in the precise patterns in which a baseball can be thrown or hit.

SUMMARY OF OBJECTS OF THE INVENTION

The present invention provides a ball which can be used under circumstances unpractical or undesirable for a baseball and for throwing or hitting in patterns in which a baseball can be thrown or hit. The ball is hollow and round and defines a plurality of identical, circular holes through the outer wall thereof. A series of separated ridges resembling stitches on a baseball are defined on the outer surface of the ball wherein the ridges are structured, raised from and form a curved loop on the outer surface substantially similar to the stitches on an actual baseball. In the preferred embodiment, the circular holes are spaced substantially equally apart from one another and the ball is constructed of high density polyethylene.

It is therefore an object of the present invention to provide a novel ball which is much lighter than a baseball and incurs more airflow drag than a baseball when thrown or hit, but which can be thrown or hit in the precise patterns in which a baseball can be thrown or hit.

It is another object of the present invention to provide such a ball which can be used as a training aid for hitting a baseball.

It is a further object of the present invention to provide such a ball which is particularly advantageous for use by children in a safe and long-lasting manner.

It is yet a further object of the present invention to provide such a ball which can be easily and simply manufactured.

Some of the objects of the invention having been stated hereinabove, other objects will become evident as the description proceeds, when taken in connection with the accompanying drawings as best described hereinbelow.

BEST MODE FOR CARRYING OUT THE INVENTION

In accordance with the present invention, a ball is provided which is much lighter than a real baseball and incurs more airflow drag than a baseball when thrown or hit. As an advantageous feature of the present invention, the ball can be thrown or hit in patterns in which a baseball can be thrown or hit, as further described hereinbelow.

Figure 1:
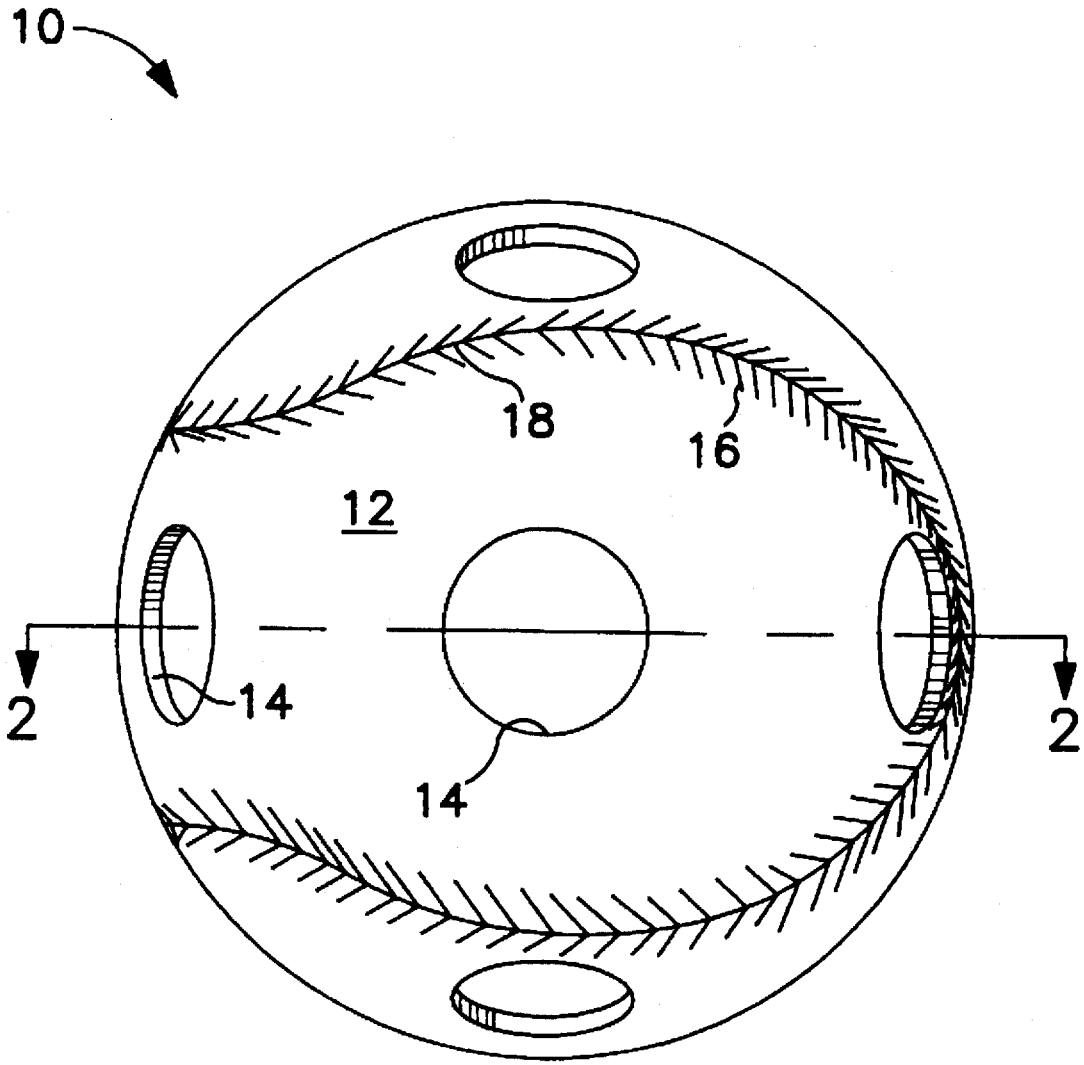
FIG. 1 of the drawings is a side elevational view of the ball according to this invention.
Figure 2:
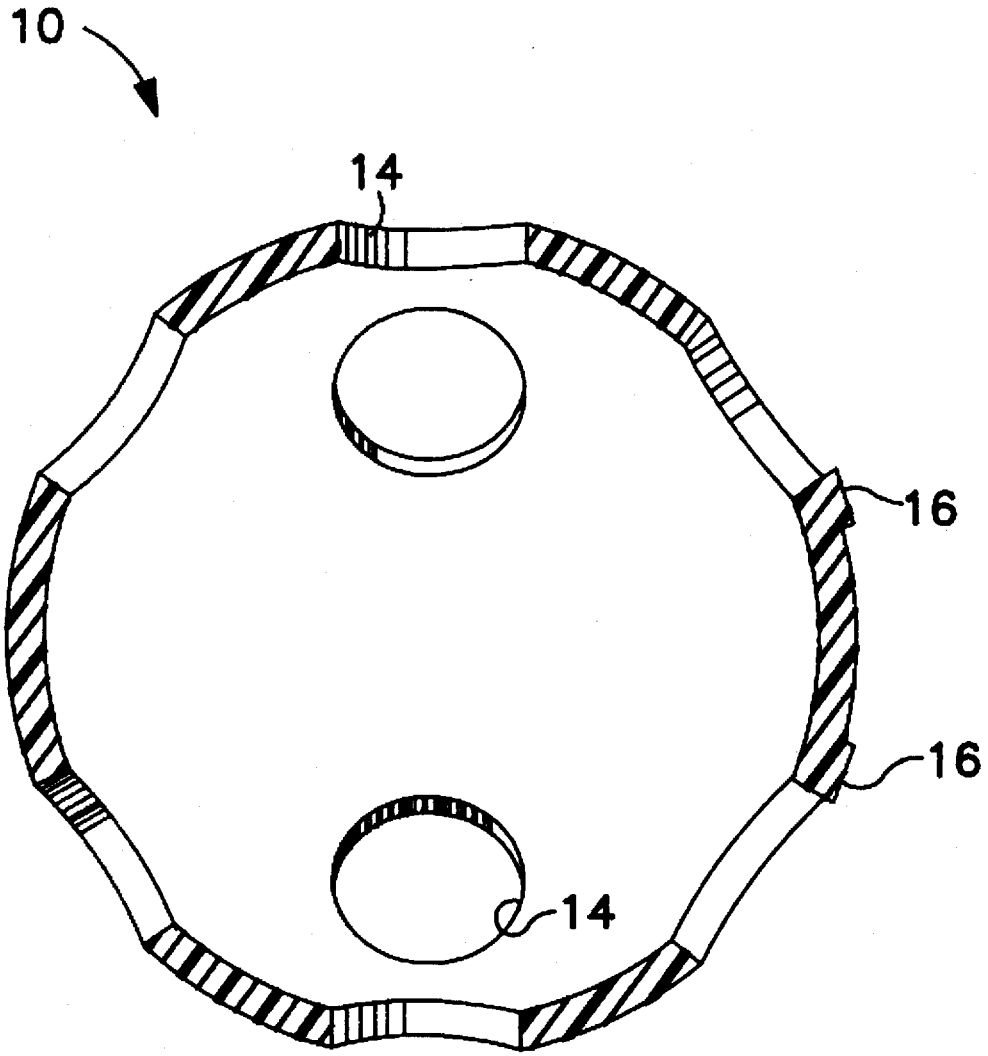
FIG. 2 of the drawings is a cross-sectional view of the ball according to this invention drawn along line 2—2 of FIG. 1.

Referring to FIG. 1 of the drawings, the ball of this invention, generally referred to as 10, is illustrated and comprises a hollow, round sphere 12 defining a plurality of holes 14 through the relatively thin outer wall of sphere 12. In the preferred embodiment, holes 14 are all identical, circular holes and equally spaced apart from one another. The outer surface of sphere 12 has a series of separated ridges 16 thereon resembling stitches on a baseball wherein the ridges are structured, raised from and form a curved loop on the outer surface substantially similar to the stitches and the pattern formed thereby on an actual baseball. In the preferred embodiment, ridges 16 are integrally defined by sphere 12 on the outer surface thereof and are raised a distance above the outer surface sufficient for a person gripping ball 10 to be able to feel ridges 16 thereon. To accomplish this, ridges 16 preferably are raised a few thousandths of an inch above the outer surface of sphere 12.

The outer surface of sphere 12 can further comprise a single, curved ridge 18 thereon which is raised from the outer surface of sphere 12 preferably no higher than ridges 16. Ridge 18 is positioned on the path formed by the series of ridges 16 so as to form an at least substantially continuous loop substantially bisecting each of ridges 16. The curved pattern of ridge 18 understandably is representative of and substantially similar to the curved pattern formed by the seam on an actual baseball. Like ridges 16, ridge 18 is preferably integrally defined by sphere 12 on the outer surface thereof. While holes 14 can be defined outside the path of the curved loop formed by ridges 16 and ridge 18 so as not to interrupt the path, it is contemplated that holes 14 can also be positioned on the path in an interrupting fashion.

Manufacturing of sphere 12 can be easily accomplished and two (2) specific methods are contemplated according to this invention. Sphere 12 can be manufactured by injection molding wherein two (2) halves with holes therein are injection molded and can then be attached together such as by gluing or welding. In the preferred embodiment, however, sphere 12 is manufactured by blow molding wherein a solid sphere is created and the plurality of holes are subsequently formed.

The preferred material of construction of sphere is polyethylene for strength and corrosion resistance. Polyethylene also provides for a smooth, low friction surface on both the outer and inner surfaces of sphere 12. When sphere 12 is manufactured in larger sizes, for example, diameters greater than approximately 2.50 inches, it is preferred that sphere 12 be constructed of low density polyethylene. When sphere 12 is manufactured in smaller sizes, however, such as sizes less than approximately 2.50 inches in diameter, it is preferred that sphere 12 be constructed of high density polyethylene which provides increased rigidity over low density polyethylene.

While it can be appreciated that sphere 12 can be manufactured in various sizes, it is preferred in accordance with this invention that sphere 12 have a diameter from approximately one and one-half (1.5) inches to three and one-half (3.5) inches. In the preferred embodiment of ball 10 according to this invention, sphere 12 has a diameter of approximately two (2) inches which is approximately one (1) inch smaller than the diameter of an actual baseball. In this preferred embodiment of ball 10, sphere 12 defines ten (10) holes 14 therethrough which are each approximately three-eighths (⅜) of an inch in diameter and equally spaced apart from one another. While it can also be appreciated that ball 10 can weigh various amounts depending upon size and material of construction, ball 10 preferably weighs between approximately 6.0 grams and 1.0 ounce. In the preferred diameter of approximately two (2) inches described above, ball 10 preferably weighs approximately 9.0 grams.

Figure 3:
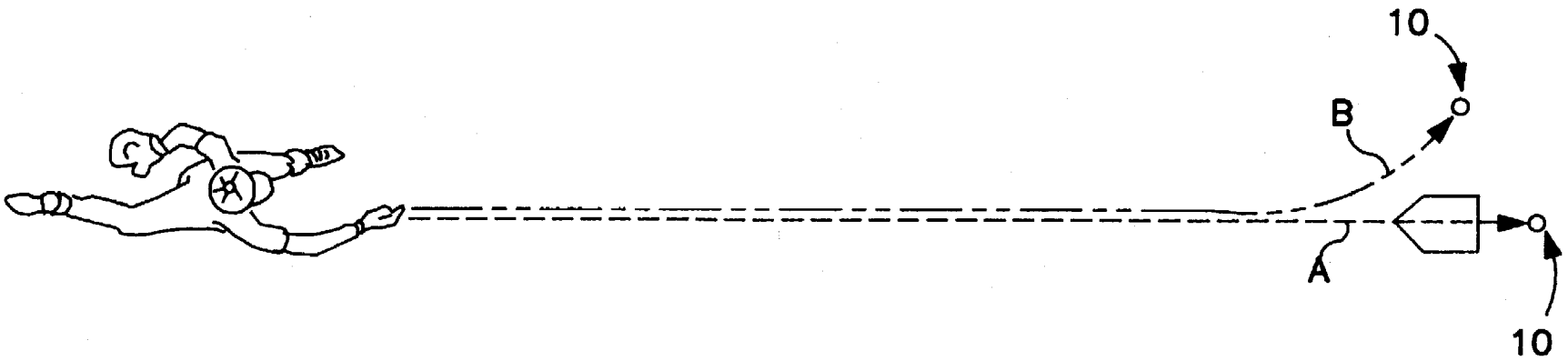
FIG. 3 of the drawings is a schematic illustration of two (2) exemplary paths in which the ball of this invention can be thrown.

In accordance with the objects of this invention, it has been found that the preferred size, lightweight nature and structure of ball 10 as described herein allows ball 10 to be thrown at a relatively fast speed in a controlled pattern. With proper gripping and throwing of ball 10 utilizing ridges 16, and ridge 18 when present, ball 10 can be thrown in patterns in which an actual baseball can be thrown such as, for example, in a straight or even curved path. FIG. 3 of the drawings illustrates, for example, straight path A as well as curved path B in which ball 10 can be thrown. Standard baseball pitches such as a fast ball, curve ball, slider and even a knuckle ball have all been found to be possible and controllable by properly throwing ball 10.

It has additionally been advantageously found that ball 10 travels in a more true, baseball-like flight pattern than prior art baseball-like balls when hit by a bat. Moreover, ball 10 understandably provides reduced potential impact when thrown or batted.

It is therefore seen that the ball of the present invention is much lighter than a baseball, and it can readily be understood that ball 10 can be thrown or hit with less stress and strain than that required to throw or hit an actual baseball. Although ball 10 incurs more airflow drag than a baseball when thrown or batted, ball 10 still can be thrown or hit in patterns in which a baseball can be thrown or hit. As such, it can be appreciated that ball 10 can be used as a significant training aid for hitting a baseball. Furthermore, it can be seen that the present invention provides a ball which is particularly advantageous for use by children in a safe and long-lasting manner as the ball of this invention can be used by young children as well as adults to play in smaller, more geographically restricted areas than an ordinary baseball park.

It will be understood that various details of the invention may be changed without departing from the scope of the invention. Furthermore, the foregoing description is for the purpose of illustration only, and not for the purpose of limitation, as the invention is defined by the following, appended claims.

What is claimed is:

1. A ball for throwing in patterns in which a baseball can be thrown, said ball comprising:

(A) a hollow, round sphere defining a plurality of holes therethrough; and (B) said sphere having an outer surface with a series of ridges thereon wherein said series of ridges is structured, raised from and forms a curved loop on said outer surface substantially similar to stitches on a baseball, said curved loop having a path which is substantially uninterrupted by said holes;

whereby said sphere can be thrown in patterns similar to patterns in which a baseball can be thrown.

2. The ball of claim 1 wherein said holes are spaced substantially equally apart from one another.

3. The ball of claim 2 wherein said holes are circular.

4. The ball of claim 1 wherein said series of ridges is defined by said outer surface of said sphere.

5. The ball of claim 1 wherein said sphere is constructed of high density polyethylene.

6. The ball of claim 1 wherein said sphere is constructed of low density polyethylene.

7. The ball of claim 1 wherein said sphere is formed by blow molding.

8. The ball of claim 1 wherein said sphere is formed by injection molding.

9. The ball of claim 1 wherein said sphere is from approximately one and one-half (1.5) inches to three and one-half (3.5) inches in diameter.

10. The ball of claim 9 wherein said sphere is approximately two (2) inches in diameter.

11. The ball of claim 10 wherein said holes are each approximately three-eighths (3/8) of an inch in diameter.

12. The ball of claim 9 wherein said sphere defines ten (10) holes therethrough.

13. The ball of claim 1 wherein said sphere weighs between approximately 6.0 grams and 1.0 ounce.

14. The ball of claim 1 wherein said outer surface of said sphere further comprises a single, ridge thereon which is raised from said outer surface and forms a curved loop in a pattern substantially similar to a seam on a baseball, said single ridge substantially bisecting each ridge of said series of ridges.

15. A ball for throwing in patterns in which a baseball can be thrown, said ball comprising:

(A) a hollow, round polyethylene sphere defining a plurality of identical circular holes therethrough wherein said holes are spaced substantially equally apart from one another; and (B) said sphere having an outer surface defining a series of separated ridges thereon wherein said series of ridges is structured, raised from and forms a curved loop on said outer surface substantially similar to stitches on a baseball, said curved loop having a path which is substantially uninterrupted by said holes;

whereby said sphere can be thrown in patterns identical to patterns in which a baseball can be thrown.

* * * * *